US005906914A

United States Patent [19]

Taguchi et al.

[11] Patent Number: 5,906,914

[45] Date of Patent: May 25, 1999

[54] SILVER HALIDE LIGHT SENSITIVE PHOTOGRAPHIC MATERIAL

[75] Inventors: Kumiko Taguchi; Sadayasu Ishikawa, both of Hino, Japan

[73] Assignee: Konica Corporation, Tokyo, Japan

[21] Appl. No.: 09/007,052

[22] Filed: Jan. 14, 1998

[30] Foreign Application Priority Data

Jan. 17, 1997 [JP] Japan ..... 9-006169

[51] Int. Cl.[6] ..... G03C 1/035

[52] U.S. Cl. ..... 430/567; 430/604; 430/605

[58] Field of Search ..... 430/567, 569, 430/604, 605

[56] References Cited

U.S. PATENT DOCUMENTS

| | | | |
|---|---|---|---|
| 5,057,409 | 10/1991 | Suga | 430/567 |
| 5,132,203 | 7/1992 | Bell et al. | 430/567 |
| 5,219,720 | 6/1993 | Black et al. | 430/567 |
| 5,334,495 | 8/1994 | Black et al. | 430/567 |
| 5,460,936 | 10/1995 | Kondo et al. | 430/567 |
| 5,478,716 | 12/1995 | Sekiya et al. | 430/567 |
| 5,508,158 | 4/1996 | Yamashita et al. | 430/567 |
| 5,587,280 | 12/1996 | Ikeda et al. | 430/567 |

FOREIGN PATENT DOCUMENTS

| | | | |
|---|---|---|---|
| 0660176 A2 | 6/1995 | European Pat. Off. | G03C 7/30 |

*Primary Examiner*—Mark F. Huff

*Attorney, Agent, or Firm*—Finnegan, Henderson, Farabow, Garrett & Dunner, L.L.P.

[57] ABSTRACT

A silver halide light sensitive photographic material is disclosed, comprising a support having thereon a silver halide emulsion layer containing tabular grains having an aspect ratio of not less than 5 and an even number of parallel twin planes, the tabular grains further satisfying the following requirements:

(A) a coefficient of variation of grain size being 20% or less, (B) $0.7 \leqq y/x \leqq 2.0$, where x represent a coefficient of variation of twin plane spacing and y represents a coefficient of variation of grain thickness, and (C) the grains having, in the interior of the grain, an internal layer having an iodide content higher than that of the grain surface, and the iodide content of the grain surface being higher than an average overall iodide content of the grains.

7 Claims, No Drawings

SILVER HALIDE LIGHT SENSITIVE PHOTOGRAPHIC MATERIAL

FIELD OF THE INVENTION

The present invention relates to a silver halide light sensitive photographic material and in particular to a silver halide light sensitive photographic material with high sensitivity and superior graininess, and improved in pressure resistance and high intensity reciprocity failure characteristics.

BACKGROUND OF THE INVENTION

Recently, with the spread of compact cameras, autofocus single-lens reflex cameras and film-incorporated cameras, there has been a strong demand for a silver halide color photographic material with high sensitivity and superior image quality. Consequently, need for improvement of photographic performance of silver halide emulsions has also become severe, and further higher level requirements for photographic performance including high speed, superior graininess and sharpness have also been made.

In response to these demands, U.S. Pat. Nos. 4,434,226; 4,439,520; 4,414,310; 4,433,048; 4,414,306 and 4,459,353 disclose techniques of using tabular silver halide grains, which is known to bring about advantages such as enhancement of sensitivity including enhanced spectral sensitization efficiency with a sensitizing dye, improved sensitivity/graininess, improved sharpness and covering power due to specific optical property of the tabular silver halide grains.

JP-A 7-191425 (herein, the term "JP-A" is referred to as unexamined, published Japanese Patent Application) describes tabular silver halide grains with an aspect ratio of less than 5 and being internally reduction-sensitized, in which a variation coefficient of twin plane spacing (x) and a variation coefficient of grain thickness(y) meet the relationship, $0.7 \leqq y/x \leqq 2.0$. These tabular grains, however, were found to provide insufficient response to recent high level requirements, and still further enhanced photographic performance is desired.

Relating to this trend of higher speed and higher image quality, the demand for improvement in pressure characteristics of silver halide light sensitive photographic materials continuously increases. There have been attempts for improving pressure characteristics by various means, in which techniques of enhancing resistance to stress of silver halide grains is generally thought to be preferable and valid in practice, rather than techniques of incorporating additives such as a plasticizer. In response to this demand, there have been extensively studied photographic emulsions comprised of core/shell type silver halide grains having a high iodide silver iodobromide stratum. In particular, there is paid attention on a silver iodobromide emulsion comprised of core/shell type grains internally having a high iodide phase containing 10 mol % or more iodide.

Techniques of improving pressure characteristics of core/shell type grains are disclosed in JP-A 59-99433, 60-35726, and 60-147727. JP-A 63-220238 and 1-201649 also disclose techniques of improving graininess, pressure characteristics and exposure intensity dependence as well as sensitivity by introducing dislocation lines within the grain. Further, JP-A 6-235988 discloses multilayered structure type, monodisperse tabular silver halide grains having a high iodide intermediate layer. These techniques, however, are still insufficient to meet recent high level requirements as a silver halide emulsion with high sensitivity, superior graininess and improved pressure characteristics.

As a technique of controlling the charge carrier within the silver halide grain, such as a free electron and positive hole, is known a metal-doping technique. For example, Leubner reported that doping of an iridium complex into the silver halide exhibited an electron-trap property [The Journal of Photographic Science Vol.31, 93 (1983)]. JP-A 3-15040 discloses an iridium ion-containing silver halide emulsion, in which iridium ions are not present on the surface of silver halide grains and also a preparation method thereof. JP-A 6-175251 discloses a technique of improving both sensitivity and reciprocity law failure characteristics at 1/100 sec. exposure with in-plane epitaxial grains, in which an iridium compound is incorporated during the course of preparing the grains. JP-A 8-160559 discloses a technique of improving high intensity reciprocity failure characteristics with tabular silver halide grains in which less than 1/20 of the total content of a polyvalent metal compound (mol/mol of AgX) is contained in the outermost surface layer. However, any of these techniques is still insufficient in providing a photographic material with the sensitivity, image quality and high intensity reciprocity failure characteristics required in the market.

SUMMARY OF THE INVENTION

In view of the foregoing circumstances, it is an object of the present invention to provide a silver halide light sensitive photographic material and in particular a silver halide light sensitive photographic material with high sensitivity and superior graininess, and improved pressure resistance and high intensity reciprocity failure characteristics.

The above object of the invention can be accomplished by the following constituent.

A silver halide light sensitive photographic material comprising a support having thereon a silver halide emulsion layer containing silver halide grains, wherein at least 50% of the total projected area of silver halide grains contained in the emulsion layer is accounted for by tabular grains having an aspect ratio of 5 or more and an even number of twin planes parallel to the major face, the tabular grains meeting the following requirements:

(A) a variation coefficient of grain size of 20% or less, (B) $0.7 \leqq y/x \leqq 2.0$, where x represent a coefficient of variation of spacing between at least two twin planes, and y represents a coefficient of variation of grain thickness, and (C) the grains having an internal layer having a silver iodide content higher than that of the grain surface, and the silver iodide content of the grain surface being higher than the average silver iodide content of the grains;

the tabular silver halide grains preferably having 5 or more dislocation lines; more preferably, the tabular grains containing a polyvalent metal compound and the surface of the grains containing the polyvalent metal compound of 1/20 or more of the average content of the grains (mol/mol of AgX).

DETAILED EXPLANATION OF THE INVENTION

A silver halide light sensitive photographic material according to the invention, comprises a support having thereon a silver halide emulsion layer containing silver halide grains, wherein at least 50% of the total projected area of silver halide grains contained in the emulsion layer is accounted for by tabular grains having an aspect ratio of 5 or more and an even number of twin planes parallel to the major face, the tabular grains meeting the following requirements (A), (B) and (C).

The requirements (A), (B) and (C) will now be further explained.

(A) The coefficient of variation of the size of the tabular grains according to the invention is to be 20% or less. The tabular grains are classified crystallographically as twin crystal grains. The twin crystal refers to silver halide crystal having one or more twin planes. Classification of forms of twin crystal grains is detailed in Klein & Moisar, Photographishe Korrespondenz, vol. 99, p 100 and ibid vol. 100 p 57.

The grain size of the tabular grains according to the invention is represented in terms of a circle equivalent diameter of the projected area of the grain (i.e., diameter of a circle having an area identical to the projected area of the silver halide grain). The grain size is preferably between 0.1 and 5.0 μm and more preferably 0.2 to 2.0 μm. The grain size of the tabular grains can be determined by magnifying the grains 10,000 to 70,000 times in an electron microscope, taking a photograph thereof and measuring the grain diameter or grain projected area on the print. The number of measured grains is at random 1,000 or more. Herein, the average grain diameter is defined as diameter (ri) at the time when $ni \cdot ri^3$ becomes maximum, where ni is the frequency of grains with a diameter ri. (significant figure is three digits with the least digit being rounded off).

The tabular grains relating to the invention are preferably monodispersed. A monodispersed silver halide grain emulsion is one in which the weight of silver halide grains included within the range of the grain diameter of ±20% of the average grain diameter is preferably not less than 60% of the total weight of grains, more preferably not less than 70%, and still more preferably not less than 89%.

Alternatively, the monodispersed grains are those in which the distribution width of the grain size (coefficient of variation of grain size), as defined below, is preferably not less than 20%, more preferably not less than 15% and still more preferably not less than 12%:

Coefficient of variation of grain size (%)=(Standard deviation/average grain size)×100 where the average grain size and the standard deviation are determined based on the ri defined above.

(B) A coefficient of variation of the spacing between twin planes (x) of tabular grains and a coefficient of variation of the thickness (y) satisfy the following requirement:

$$0.7 \leqq y/x \leqq 2.0$$

Tabular grains according to the invention have an even number of twin planes parallel to the major faces, and the twin planes can be observed with a transmission electron microscope. More concretely, a sample is prepared by coating a silver halide emulsion on a support so as to allow the major faces of silver halide grains to be oriented parallel to the support. The sample is sliced to a thickness of ca. 0.1 μm by using a diamond cutter. The slice is observed with a transmission electron microscope to confirm the presence of twin planes. In the invention, the spacing between twin planes (i.e., twin plane spacing) is defined as a shortest distance selected from the distances between adjacent even-numbered twin planes in the tabular grain. A mean twin plane spacing of tabular grains can be obtained by arbitrarily selecting 1,000 or more grains exhibiting a section vertical to the major face and arithmetically averaging the twin plane spacings of the grains. In the invention, "coefficient of variation of a twin plane spacing (x)" indicates the extent of fluctuation in the twin plane spacings of the grains and is defined as the standard deviation of the twin plane spacing divided by the mean twin plane spacing, expressed in terms of percentage. The mean twin plane spacing, according to the invention, is preferably 0.01 to 0.05 μm and more preferably 0.013 to 0.03 μm.

The thickness of the tabular grains can be determined by observing the grains with an transmission electron microscope. The mean grain thickness can be obtained by averaging the thickness of each grain. The mean grain thickness of the tabular grains is preferably 0.05 to 1.5 μm and more preferably 0.15 to 1.0 m. In the invention, a coefficient of variation of grain thickness represents an extent of variation (or fluctuation) of the thickness of the tabular grains, and defined as the standard deviation of grain thickness divided by the mean grain thickness, expresssed as a percentage.

The tabular grains used in the invention satisfy the following relationship between the coefficient of variation of twin plane spacing (x) and the coefficient of variation of grain thickness (y), $0.7 \leqq y/x \leqq 2.0$, more preferably $0.8 \leqq y/x \leqq 1.6$ and furthermore preferably $0.9 \leqq y/x \leqq 1.3$. When y/x is less than 0.7, variation of the twin plane spacing is too large, sufficient sensitivity and graininess can not be obtained. When y/x is more than 2.0, the variation of the grain thickness is too large, whereby sufficient sensitivity and graininess can not be achieved.

According to the invention, the twin plane spacing can be controlled by optimally selecting parameters affecting super-saturation at the time of nucleation, such as gelatin concentration, gelatin type, temperature, iodide concentration, pBr, pH, ion-supplying rate and stirring rate. In general, the twin plane spacing can be shorted by performing nucleation under highly supersatuarated conditions. Details regarding the parameters of super-saturation are referred to JP-A 3-92924 and 1-213637.

In the invention, to bring the value of y/x into the range of the invention, the following embodiment is preferred.

(1) A low molecular weight gelatin having an average molecular weight of 60,000 or less (preferably 20,000 or less) is employed at the stage of the nucleation, and a polyalkyleneoxide block copolymer is concurrently present.

(2) In the nucleation process, in general, non-twinned crystal grains or non-parallel multi-twinned crystal grains other than fine tabular nucleus grains are likely to be produced. To allow fine grains, other than the tabular nucleus grains, to prevent from forming as much as possible, it is preferred to perform ripening by raising the temperature by 20 to 60° C. (preferably, 25 to 40° C.) from the nucleating temperature, after completion of the nucleation. Further, to enhance monodispersibility of the grains, the temperature-raising time is preferably shortened, more preferably not more than 2.5 min./°C. and still more preferably, not more than 1.5 min./°C.

(C) The tabular grains used in the invention have a layer in the interior of the grain which has an iodide content higher than that of the grain surface, and the iodide content of the grain surface is higher than the average overall content of the grains.

In the invention, the grain surface of the tabular grains is referred to as an outermost layer including the outermost surface, having a depth 50 Å from the outermost surface. Halide composition of the surface of the tabular grains can be determined by the XPS method (X-ray Photoelectron Spectroscopy).

A sample was cooled to −115° C. or lower under a super-high vacuum of $1\times10^{-8}$ torr or less, exposed to X-ray of Mg-Kα line generated at an X-ray source voltage of 15 kV and an X-ray source current of 40 mA and measured with respect to Ag3d5/2, Br3d and I3d3/2 electrons. From the integrated intensity of a measured peak which has been corrected with a sensitivity factor, the halide composition of the surface can be determined. The XPS method is known as a technique of measuring the iodide content of the surface of silver halide grains, as disclosed in JP-A 2-24188. When measured at room temperature, however, X-ray irradiation destroys a sample so that the iodide content of the outermost surface could not be accurately determined. The inventors of the present invention succeeded in accurate determination of the iodide content of the surface by cooling the sample to a temperature at which no destruction of the sample occurred. As a result, it is proved that, in core/shell grains which have a different composition between the interior and the surface, and grains in which a high iodide (or low iodide) layer is localized in the surface region, a value measured at room temperature is quite different from the true composition, due to decomposition of silver halide and diffusion of the halide (particularly, iodide).

Procedure of the XPS method employed in the invention is as follows. To an emulsion is added a 0.05% by weight proteinase aqueous solution and stirred at 45° C. for 30 min. to degrade the gelatin. After centrifuging and sedimenting the emulsion grains, the supernatant is removed. Then, distilled water is added thereto and the grains are redispersed. The resulting solution is coated on the mirror-finished surface of a silicon wafer to prepare a sample. Using the thus prepared sample, measurement of the surface iodide was conducte by the XPS method. In order to prevent sample destruction due to X-ray irradiation, the sample was cooled to −110 to −120° C. in a measuring chamber, exposed to X-ray of Mg-Kα line generated at an X-ray source voltage of 15 kV and an X-ray source current of 40 mA and measured with respect to Ag3d5/2, Br3d and I3d3/2 electrons. From the integrated intensity of a measured peak which has been corrected with a sensitivity factor, the halide composition of the surface can be determined. In the invention, the interior of the grain is referred to as an internal region within the grain in a depth of 50 Å or more from the outermost surface.

The difference in the iodide content between the surface and an internal high iodide layer of the tabular grains is preferably not less than 2 mol % and more preferably not less than 4 mol %. The iodide content of the surface of the tabular grains is preferably 2.6 to 16 mol % and more preferably 3 to 10 mol %. The tabular grains according to the invention have an internal layer having a higher iodide content than that of the grain surface, however, the position thereof is not specifically limited. The volume of the internal high iodide containing layer is preferably 1 to 50% and more preferably 5 to 20%, based on silver of the total grains.

The tabular grains used in the invention meet the requirement that the iodide content of the grain surface is higher than the average iodide content of the grains. The ratio of the surface iodide content to the average iodide content is preferably 1.3 to 30, and more preferably 1.5 to 15. The tabular grains used in the invention are mainly comprised of silver iodobromide, and may have other silver halide composition, such as silver chloride, within a range which has no impairing effects of the invention.

In the invention, at least 50% of the projected area of the total grains contained in at least one emulsion layer is accounted for by tabular grains having even-numbered twin planes and an aspect ratio of 5 or more. The tabular grains each have preferably 5 or more dislocation lines, more preferably 10 or more dislocation lines and furthermore preferably 20 to 100 dislocation lines. The dislocation line according to the invention means an edge-form lattice defect, in which a boundary between a slipped region and non-slipped region is formed on the slip plane of the crystal.

The dislocation lines in tabular grains can be directly observed by means of transmission electron microscopy at a low temperature, for example, in accordance with methods described in J. F. Hamilton, Phot. Sci. Eng. 11 (1967) 57 and T. Shiozawa, Journal of the Society of Photographic Science and Technology of Japan, 35 (1972) 213. Silver halide tabular grains are taken out from an emulsion while making sure not to exert any pressure that causes dislocation in the grains, and they are placed on a mesh for electron microscopy. The sample is observed in transmission electron microscopy, while cooled to prevent the grain from being damaged (e.g., printing-out) by electron beam. Since electron beam penetration is hampered as the grain thickness increases, sharper observation is obtained when using an electron microscope of high voltage type (over 200 KV for 0.25 μm thick grains). From the thus-obtained electron micrograph, the position and number of the dislocation lines in each grain can be determined, when viewed perpendicularly to the major face.

The tabular grains relating to the invention preferably have 5 or more dislocation lines within the grain. It is preferable that at least 50% of the total projected area of the tabular grains contained in the emulsion layer is accounted for by grains having 5 or more dislocation lines. Thus, when transmission electronmicrographs of silver halide grains contained in the emulsion layer are taken and therefrom, at random at least 500 tabular grains are extracted, in which the presence of the dislocation line(s) can be observed, the sum of the projected area of the grains having not less than 5 dislocation lines, which exceeds the sum of the projected area of the grains having less than 5 dislocation lines.

With respect to the position of the dislocation lines in the tabular grains relating to the present invention, it is preferable that the dislocation lines exist in the fringe portions of the major face. The term, "fringe portion" refers to the peripheral portion of the major face of the tabular grain. More specifically, when a straight line is drawn outwardly from the center of gravity of the projection area projected from the major face-side, the dislocation lines exist in a region beyond 50% of the distance (L) between the intersection of a straight line with the periphery and the center, preferably, 70% or outer and more preferably 80% or outer. (In other words, the dislocation lines are located in the region between 0.5 L and L outwardly from the center of each grain, preferably between 0.7 L and L, more preferably between 0.8 L and L.)

The method for introducing the dislocation lines into the silver halide grain is optional. The dislocation lines can be introduced by various methods, in which, at a desired time of introducing the dislocation lines during the course of forming silver halide grains, an iodide (e.g., potassium iodide) aqueous solution is added, along with a silver salt (e.g., silver nitrate) solution and without addition of a halide other than iodide by a double jet technique, silver iodide fine grains are added, only an iodide solution is added, or a compound capable of releasing an iodide ion disclosed in JP-A 6-11781 (1994) is employed. Among these, it is preferable to add iodide and silver salt solutions by a double jet technique, or to add silver iodide fine grains or an iodide ion releasing compound, as an iodide source. It is more preferable to add silver iodide fine grains. In this case, the number of the dislocation lines can be controlled by varying the addition amount of the potassium iodide aqueous solution, iodide ion-releasing compound or silver iodide fine grains, taking account of the size or aspect ratio of silver halide grains, the composition of silver halide grains at the time of addition and the pBr within the reaction vessel. More concretely, the addition amount is preferably 0.2 to 10 mol % and more preferably 0.5 to 5 mol %, based on silver of the total grains. It is also possible to control the position of the dislocation lines to be introduced by optimally selecting the method for introducing the dislocation lines, the composition of the surface of the tabular grains or the pBr within the reaction vessel, or alternatively by using a material capable of being adsorbed onto the tabular grains, such as a crystal habit-controlling agent. It is preferable to introduce the dislocation lines at a time after 50% (preferably 60%) of the total silver salt is added and before 95% (preferably 80%) of the total silver salt is added, during the course of forming silver halide grains used in the invention.

The tabular grains used in the invention preferably contain a polyvalent metal compound (preferably, in the interior of the grain). The polyvalent metal compound is contained in the surface of the tabular grains, preferably in an amount of not less than 1/20(more preferable, not less than 1/10) of the total content of the metal compound (mol/mol of AgX).

A polyvalent metal is selected from the group consisting of Mg, Al, Ca, Sc, Ti, V, Cr, Mn, Fe, Co, Cu, Zn, Ga, Ge, Sr, Y, Zr, Nb, Mo, Tc, Ru, Rh, Pd, Cd, Sn, Ba, Ce, Eu, W, Re, Os, Tr, Pt, Hg, Tl, Pb, Bi and In. The polyvalent metal compound is preferably selected from mono-salts or metal complexes. The metal complex may be a 6-coordinated, 5-coordinated 4-coordinated or 2-coordinated complex and more preferably octahedral 6-coordinated complex or planar 4-coordinated complex. The metal complex may be a mononucleus complex or polynucleus complex. Examples of ligands constituting the complex include $CN^-$, CO, $NO_2^-$, 1,10-phenanthroline, 2,2'-bipyridine, $SO_3^-$, ethylenediamine, $NH_3$, pyridine, $H_2O$, $NCS^-$, $NCO^-$, $N_3^-$, $SO_4^-$, $OH^-$, $N_3^-$, $S_2^-$, $F^-$, $Cl^-$, $Br^-$ and $I^-$. Of the polyvalent metal compounds preferred are $K_4Fe(CN)_6$, $K_3Fe(CN)_6$, $Pb(NO_3)_2$, $K_2IrCl_6$, $K_3IrCl_6$, $K_2TrBr_6$, $InCL_3$.

The polyvalent metal compound is contained preferably in an amount of $10^{-9}$ to $10^{-4}$ and more preferably $10^{-9}$ to $10^{-5}$ mol per mol of silver halide. Distribution of the polyvalent metal compound within the tabular grain can be determined, for example, by fractionally dissolving the grain from the surface and measuring the content of each fraction according to the following manner.

Prior to determination of the content of the polyvalent compound, a silver halide tabular grain emulsion is subjected to the following pre-treatment. To about 30 ml of the emulsion is added 50 ml of a 0.2% actinase aqueous solution and stirred continuously at 40° C. for 30 min. to perform degradation of the gelatin. This procedure is repeated five times. After centrifuging, washing is repeated five times with 50 ml of methanol, two times with 50 ml of 1N nitric acid solution and five times with ultra-pure water, and after centrifuging, only tabular grains are separated. A surface portion of the resulting tabular grains is dissolved with aqueous ammonia or pH-adjusted ammonia (in which the concentration of ammonia or the pH is varied according to the kind of silver halide and the dissolution amount). Of the tabular grains, for example, the outermost surface portion of silver bromide grains can be dissolved to an extent of about 3% from the surface, using 20 ml of 10% aqueous ammonia per 2 g of silver bromide grains. The amount of dissolved silver bromide can be determined in the following manner. After dissolving, the solution is subjected to centrifuging to separate any remaining silver bromide grains and the amount of silver contained in the resulting supernatant can be determined with a high frequency induction plasma mass spectrometer (ICP-MS), a high frequency induction plasma emission spectral analyzer (ICP-AES) or an atomic absorption spectrometer. From the difference in the content of the polyvalent metal compound between the surface-dissolved silver bromide grains and the undissolved silver bromide grains, the amount of the polyvalent metal compound present in about the grain surface of 3% (i.e., it means that silver halide corresponding to about 3% of the total silver amount is dissolved from the surface).

To determine the content of the polyvalent metal compound, after dissolving in an aqueous ammonium thiosulfate solution, aqueous sodium thiosulfate solution or aqueous potassium cyanide solution and the resulting solution, quantitative analysis is performed by an ICP-MS method, an ICP-AES method or an atomic absorption method. In the case when using potassium cyanide as a solvent and ICP-MS (FISON produced by Elemental Analysis Corp.) as an analyzer, for example, about 40 mg of tabular silver halide grains is dissolved in 5 ml of an aqueous 0.2N potassium cyanide solution, a solution of an internal standard element Cs is added thereto in an amount 10 ppb and a measuring sample is prepared further by adding ultra-pure water to make a total volume 100 ml. Using a calibration curve with respect to a polyvalent metal compound which has been prepared by the use of tabular silver halide grains free from the polyvalent metal compound, the content of the polyvalent metal compound contained in a sample is determined by the ICP-MS method. In this case, a measuring sample is diluted by 100 times with ultra-pure water and the silver content thereof is measured with the ICP-AES method or atomic absorption method. After dissolving the grain surface, the tabular grains is washed with ultra-pure water and the content of the polyvalent metal compound in the internal direction of the grain can be determined by repeating the dissolution of the grain surface in the same manner as described above.

The surface of the tabular grains in the invention (i.e. grain surface) is referred to as the portion corresponding to not less than 10% of the total silver amount of the grains, as the dissolved silver amount when the tabular grains is subjected to the surface dissolution treatment in such a manner as above-described.

The method for adding the polyvalent metal compound used in the invention is not specifically limited. Thus, the metal compound is dissolved in water of an organic solvent such as methanol or acetone and added in the form of a solution, or is directly added in the form of a solid fine particle dispersion.

Tabular silver halide grains used in the invention are prepared preferably by growing seed grains. Concretely, to a reaction vessel having an aqueous solution containing a protective colloid and seed grains are supplied silver ions, halide ions and optionally silver halide fine grains to grow the seed grains. The seed grains can be prepared by any method known in the photographic art, such as a single-jet addition or double-jet addition. The halide composition of the seed grains is optional and any of silver bromide, silver chloride, silver iodobromide, silver iodochloride, silver chlorobromide and silver iodochlorobromide can be employed. Of these, silver bromide and silver iodobromide are preferable and silver iodobromide is more preferable. Silver iodobromide contains preferably 1 to 10 mol % iodide.

In cases where the tabular grains are prepared by growing seed grains, the central portion of the grain may have a different halide composition from that of the core. The seed grains preferably account for not more than 50%, and more preferably not more than 10% of the total silver halide, based on silver.

Tabular silver halide grains used in the invention are each comprised of a core and a shell which covers the core. The shell may be comprised of one or more layers. The halide composition of the core and shell is optional. The proportion of the core is preferably 1 to 60% and more preferably 4 to 40%, based on silver of the grain. In cases where the core is different in the iodide content from the shell, it is preferable to have a sharp boundary between the core and the shell with respect to the iodide content. It is also preferable that an intermediate layer be present between the core and the shell. The proportion of the intermediate layer is preferably 0.1 to 20% and more preferably 0.5 to 10%, based on silver, of the grain. The iodide content of the intermediate layer preferably is higher, by 2 mol % or more, than that of the shell.

Distribution of the iodide within core/shell type silver halide grains can be determined by a variety of physical measuring methods, such as measurement of luminescence at low temperature and X-ray diffractometry as described in Abstracts of Annual Meeting of the Society of Photographic Science and Technology of Japan (1981).

Tabular silver halide grains used in the invention can be prepared by a variety of methods known in the art, such as single-jet addition, controlled double-jet addition and controlled triple-jet addition. To prepare highly monodispersed grains, it is important to control the pAg of the liquid phase in which silver halide grains are formed, in proportion to the growing rate of silver halide grains. The pAg is to be within the range of 7.0 to 11.0, preferably 7.5 to 10.5 and more preferably 8.0 to 10.0. The flow rate is referred to techniques described in JP-A 54-48521 and 58-49938.

The tabular grains used in the invention can be prepared in the presence of known silver halide solvents, such as ammonia, thioethers and thioureas. The tabular grains may be surface latent image forming grains or internal latent image forming grains.

The tabular grains can be prepared in the presence of a dispersing medium, i.e. in a solution containing a dispersing medium. The solution containing a dispersing medium is referred to as an aqueous solution in which a protective colloid is formed with a material such as gelatins or other hydrophilic colloids (material usable as a binder), and is preferably an aqueous solution containing gelatin as a protective colloid. As gelatin usable in the invention, any type of gelatin can be employed, including lime-processed gelatin and acid-processed gelatin. Details of the preparation method of gelatin are referred to A. Veis, "The Macromolecular Chemistry of Gelatin" (Academic Press, 1964). Examples of hydrophilic colloids usable as a protective colloid, other than gelatin, include gelatin derivatives, a graft polymer of gelatin and another polymer, proteins such as albumin and casein, cellulose derivatives such as hydroxyethyl cellulose, carboxymethyl cellulose and cellulose sulfuric acid ester, sodium alginic acid, saccharine derivatives such as starch derivatives, and synthetic hydrophilic polymer materials such as polyvinyl alcohol, partial acetal of polyvinyl alcohol, poly-N-vinyl pyrrolidone, polyacrylic acid, polymethacrylic acid, polyacrylamide, polyvinyl imidazole, polyvinyl pyrazole, and their respective copolymer. In the case of gelatin, there is preferably employed gelatin having a jelly strength of 200 or more, as defined in PAGI method.

A tabular grain emulsion used in the invention, after completing growth of the tabular grains, can be desalted to remove soluble salts. Desalting can be performed any time during the course of growing the grains, as described in JP-A 60-138538. Desalting is conducted based on the method described in Research Disclosure (hereinafter, denoted as "RD") 17643, section II. More concretely, to remove soluble salts from an emulsion after completion of grain formation or physical ripening, there may be employed a noodle washing method in which gelatin is gelled, and flocculation method in which inorganic salts, anionic surfactants, anionic polymers (e.g. polystyrene sulfonic acid), gelatin derivatives (e.g. acylated gelatin, carbamoyl gelatin) are employed.

The iodide content of each of silver halide grains (including tabular grains), and the average iodide content can be determined by the EPMA method (Electron Probe Micro Analyzer method). Thus, a sample can be prepared, in which silver halide grains are dispersed so as not to be in contact with each other, and an electron beam is irradiated onto each grain. Elemental analysis of a minute portion can be made through analysis of X-rays produced by electron beam excitation. According to this method, the halide composition of each grain can be determined by measuring characteristic X-ray strengths of silver and iodide, radiating from each grain. The average iodide content can be determined by obtaining iodide contents of at least 50 grains through the EPMA method. In the tabular grains used in the invention, it is preferred that the iodide distribution among grains be uniform. When the iodide distribution among the grains is measured by the EPMA method, the relative standard deviation is preferably not more than 30%, and more preferably not more than 20%.

Tabular grains used in the invention can be chemically sensitized by any of the several conventional methods. Thus, sulfur sensitization, selenium sensitization or noble metal sensitization with gold or other noble metals may be employed singly or in combination thereof.

The tabular grains can also be optically sensitized to a desired wavelength region using a sensitizing dye known in the photographic art. The sensitizing dye can be employed singly or in combination thereof. There may be incorporated, with the sensitizing dye, a dye having no spectral sensitizing ability or a supersensitizer which does not substantially absorb visible light and enhances sensitization of the dye.

An antifoggant and stabilizer can be added into the tabular grain emulsion. Gelatin is advantageously employed as a binder. An emulsion layer or other hydrophilic colloid layers can be hardened with hardeners. A plasticizer or a dispersion of a water-soluble or water-insoluble polymer (so-called latex) can be incorporated.

In a silver halide emulsion layer of a photographic material, a coupler can be employed. There can also be employed a competing coupler having an effect of color correction and a compound which, upon coupling reaction with an oxidation product of a developing agent, is capable of releasing a photographically useful fragment, such as a developing accelerator, a developing agent, a silver halide solvent, a toning agent, hardener, a fogging agent, a chemical sensitizer, a spectral sensitizer and a desensitizer.

A filter layer, anti-halation layer or anti-irradiation layer can be provided in the photographic material relating to the invention. In these layers and/or an emulsion layer, a dye which is leachable from a processed photographic material or bleachable during processing, can be incorporated. Furthermore, a matting agent, lubricant, image stabilizer, formalin scavenger, UV absorbent, brightening agent, surfactant, development accelerator or development retarder is also incorporated into the photographic material.

Employed may be, as a support, polyethylene-laminated paper, polyethylene terephthalate film, baryta paper or cellulose triacetate film.

EXAMPLES

Embodiments of the present invention will be further explained, based on examples but the invention is not limited to these examples.

Example 1

Preparation of seed grain emulsion T-1

According to the following procedure, there was prepared a seed grain emulsion comprised of twin crystal grains having two parallel twin planes.

| | |
|---|---|
| Solution A | |
| Ossein gelatin | 24.2 g |
| Potassium bromide | 10.75 g |
| Nitric acid (1.2N) | 118.6 ml |
| $HO(CH_2CH_2O)_m(CH(CH_3)HCH_2O)_{19.8}(CH_2CH_2O)_nH$ (m + n = 9.77) 10 wt. % methanol solution | 6.78 ml |
| Distilled water to make | 9686 ml |
| Solution B | |
| Silver nitrate | 1200 g |
| Distilled water to make | 2826 ml |
| Solution C | |
| Potassium bromide | 823.8 g |
| Potassium iodide | 23.46 g |
| Distilled water to make | 2826 ml |
| Solution D | |
| Ossein gelatin | 120.9 g |
| Distilled water to make | 2130 ml |
| Solution E | |
| Potassium bromide | 76.48 g |
| Distilled water to make | 376 ml |
| Solution F | |
| Potassium hydroxide | 10.06 g |
| Distilled water to make | 340 ml |

To solution A at 35° C. with vigorously stirring were added 464 ml of solution B and 464 ml of solution C by the double jet method over a period of 2 min. to form nucleus grains, while the pAg was maintained at 10.02 by using solution E. Then, the temperature was raised to 60° C. taking 66 min. At the time when the temperature reached 55° C., solution D was added taking 7 min. At the time when the temperature reached 60° C., solution F was added taking 1 min. and subsequently, 2362 ml of solution B and 2362 ml of solution C wee added over a period of 43 min. The pAg was maintained at 9.17 immediately after raising the temperature. After completing addition of solutions B and C, the emulsion was desalted according to the conventional manner. To the desalted emulsion was added an aqueous 10 wt. % gelatin solution, stirring was further continued at 55k C. for 30 min. and distilled water was added to prepare an emulsion of 5,360 g. Electron microscopic observation revealed that the resulting emulsion was comprised of tabular grains having two parallel twin planes. It was also proved that the resulting seed grains had an average grain diameter of 0.445 μm and an aspect ratio of 6.0 at the time of 50% of the projected area, and grains having two parallel twin planes accounted for 75% of the total grain projected area.

Preparation of seed grain emulsion T-2

A twin crystal seed grain emulsion T-2 was prepared in the same manner as emulsion T-1, except that ossein gelatin used in solution A was replaced by a low molecular weight gelatin having a molecular weight of 15,000. It was proved that the resulting seed grains had an average grain diameter of 0.445 μm and an aspect ratio of 6.0 at the time of 50% of the projected area, and grains having two parallel twin planes accounted for 80% of the total grain projected area.

Preparation of seed grain emulsion T-3

A twin crystal seed grain emulsion T-3 was prepared in the same manner as emulsion T-2, except that the time for raising the temperature to 60° C. after nucleation was changed to 30 min. It was proved that the resulting seed grains had an average grain diameter of 0.445 μm and an aspect ratio of 6.0 at the time of 50% of the projected area, and grains having two parallel twin planes accounted for 90% of the total grain projected area.

Preparation of emulsion EM-1

Using the following six kinds of solutions, emulsion EM-1 was prepared.

| | |
|---|---|
| Solution A | |
| Ossein gelatin | 163.4 g |
| $HO(CH_2CH_2O)_m(CH(CH_3)HCH_2O)_{19.8}(CH_2CH_2O)_nH$ (m + n = 9.77) 10 wt. % methanol solution | 2.50 ml |
| Seed grain emulsion T-3 | 674.5 g |
| Potassium bromide | 3.0 g |
| Distilled water to make | 3500 ml |
| Solution B | |
| Silver nitrate | 2581.7 g |
| Distilled water to make | 4342 ml |
| Solution C | |
| Potassium bromide | 1828.3 g |
| Distilled water to make | 4390 ml |
| Solution D | |
| Potassium bromide aqueous solution (1.75N) | |
| Solution E | |
| Acetic acid aqueous solution (56 wt. %) | |
| Solution F | |
| Fine grain emulsion comprised of 3 wt. % gelatin and silver iodide (av. size, 0.05 μm) | 2793 g |

The above fine grain emulsion was prepared in the following manner. To 5000 ml of a 6.0 wt. % gelatin solution containing 0.06 mol of potassium iodide, an aqueous solution containing 7.06 mol of silver nitrate and an aqueous solution containing 7.06 mol of potassium iodide, 2000 ml of each were added over a period of 10 min., while the pH was maintained at 2.0 using nitric acid and the temperature was maintained at 40° C. After completion of grain formation, the pH was adjusted to 6.0 using a sodium carbonate aqueous solution. The finished weight of the emulsion was 12.53 kg.

To solution A maintained at 75° C. with stirring were added solutions B, C and F by triple-jet addition or single-jet addition according to the conditions as shown in Table 1 to grow seed crystal grains to obtain a silver halide tabular grain emulsion. Flow rates of solutions B, C and F at the triple-jet addition and a flow rate of solution F at the single-jet addition were each acceleratedly varied so as to meet the critical growth rate to prevent production of new nucleus grain and widening of grain size distribution due to Ostwald ripening. The pAg and pH were each controlled using solutions D and E, during the course of growing grains. After completing grain growth, the emulsion was desalted according to the method described in JP-A 5-72658. Then, gelatin was further added thereto to redisperse the emulsion and the pH and pAg were adjusted to 5.80 and 8.06, respectively.

TABLE 1

| Mixing time | Flow rate (ml/min) | | | | | Temperature |
|---|---|---|---|---|---|---|
| (min) | B | C | F | pH | pAg | (° C.) |
| 0.00 | 7.8 | 7.5 | 3.8 | 4.0 | 8.6 | 75 |
| 23.2 | 9.9 | 9.5 | 4.8 | 4.0 | 8.6 | 75 |
| 45.5 | 12.3 | 11.8 | 6.0 | 4.0 | 8.6 | 75 |
| 85.7 | 15.1 | 14.5 | 7.4 | 4.0 | 8.6 | 75 |
| 102.1 | 16.1 | 15.5 | 7.9 | 4.0 | 8.6 | 75 |
| 120.5 | 17.2 | 16.5 | 8.4 | 4.0 | 8.6 | 75 |
| 141.2 | 18.4 | 17.6 | 9.0 | 4.0 | 8.6 | 75 |
| 164.3 | 19.6 | 18.7 | 9.6 | 4.0 | 8.6 | 75 |
| 190.2 | 22.8 | 32.7 | 10.2 | 4.0 | 8.6 | 75 |
| 190.3 | 0.0 | 0.0 | 266.0 | 4.0 | 8.6 | 75 |
| 192.3 | 0.0 | 0.0 | 266.0 | 4.0 | 9.6 | 75 |
| 192.4 | 9.6 | 12.0 | 3.8 | 4.0 | 9.6 | 75 |
| 202.7 | 76.7 | 82.1 | 30.2 | 4.0 | 9.6 | 75 |
| 204.7 | 83.0 | 89.0 | 31.7 | 4.0 | 9.6 | 75 |
| 204.8 | 83.4 | 89.2 | 13.6 | 4.0 | 9.6 | 75 |
| 213.0 | 87.1 | 93.2 | 14.2 | 4.0 | 9.6 | 75 |

From electron micrographs of the resulting emulsion grains, 79.2% of the resulting emulsion was accounted for by tabular grains having an average grain diameter of 1.348 μm (mean value of circle-equivalent diameters), an aspect ratio of 5.0 or more, and a variation coefficient (V.C.) of grain size of 12.0%. It was further proved that the tabular grains exhibited characteristic values with respect of variation coefficients of the spacing and the grain thickness, and the iodide content, as shown in Table 2. Furthermore, transmission electron microscopic observation revealed that at least 80% of the total grain projected area was accounted for by grains each having 10 or more dislocation lines in the fringe portion.

Preparation of emulsion EM-2

An emulsion EM-2 was prepared in the same manner as EM-1, except that the seed grain emulsion (T-3) was replaced by T-1.

Preparation of emulsion EM-3

An emulsion EM-3 was prepared in the same manner as EM-1, except that after the mixing time of 192.3 min., the pAg was changed to 10.5 and the flow rate of each solution was acceleratedly varied so as to meet the growing rate of silver halide grains.

Preparation of emulsion EM-4

An emulsion EM-4 was prepared in the same manner as EM-1, except that single-jet addition of solution of solution F was interrupted over a period of 2 min. after the mixing time of 190.3 min. As a result of observation of the resulting emulsion grains by a transmission electron microscope, there was found no grains having dislocation line.

Preparation of emulsion EM-5

An emulsion EM-5 was prepared in the same manner as EM-4, except that the pAg at the time of forming a core portion and the pAg at the time of forming a shell portion were changed to 7.9 and 9.1, respectively, and the flow rate of each solution was acceleratedly varied so as to meet the growing rate of silver halide grains.

Preparation of emulsion EM-6

An emulsion EM-6 was prepared in the same manner as EM-4, except that the seed grain emulsion was replaced by T-2.

Preparation of emulsion EM-7

An emulsion EM-7 was prepared in the same manner as EM-4, except that the flow rate of each solution was proportionally lowered and the mixing time was extended to 1.5 times.

Preparation of emulsion EM-8

An emulsion EM-8 was prepared in the same manner as EM-4, except that the flow rate of each solution was varied.

Preparation of emulsion EM-9

An emulsion EM-9 was prepared in the same manner as EM-4, except that when an average diameter of growing grains reached 1.281 μm, solution G described below was instantaneously added, while addition of solutions B, C and F was continued.

| Solution G | |
|---|---|
| $K_2IrCl_6$ | 0.829 mg |
| Nitric acid (specific gravity of 1.38) | 0.50 ml |
| 25 wt. % NaCl aqueous solution to make | 50 ml |

Preparation of emulsion EM-10

An emulsion EM-10 was prepared in the same manner as EM-9, except that when an average diameter of growing grains reached 1.069 μm, solution G was added.

Preparation of emulsion EM-11

An emulsion EM-11 was prepared in the same manner as EM-9, except that the seed grain emulsion was replaced by T-1.

Preparation of emulsion EM-12

An emulsion EM-12 was prepared in the same manner as EM-1, except that solution G was instantaneously added, while addition of solutions B, C and F was continued.

Characteristics of prepared emulsions are shown in Table 2.

TABLE 2

| Emul- | Seed emul- | Tabular grains | V.C. of grain size | x | y | | Iodide content (mol %) Inter- | Grain sur- | Over- | Dislo- | Ir content (mol/mol Agx) | | Ag con- | Re- |
|---|---|---|---|---|---|---|---|---|---|---|---|---|---|---|
| sion | sion | (%) | (%) | (%) | (%) | y/x | layer | face | all | cation line | Overall | Surface | tent | mark |
| EM-1 | T-3 | 79.2 | 12.0 | 16.8 | 19.3 | 1.15 | 35.5 | 15.43 | 9.06 | Yes | — | — | — | Inv. |
| EM-2 | T-1 | 64.1 | 22.1 | 8.9 | 28.9 | 3.25 | 35.5 | 13.29 | 9.06 | Yes | — | — | — | Comp. |
| EM-3 | T-3 | 93.6 | 14.3 | 12.2 | 15.1 | 1.24 | 35.5 | 15.98 | 9.06 | Yes | — | — | — | Inv. |
| EM-4 | T-3 | 80.5 | 10.4 | 14.2 | 16.5 | 1.16 | 13.0 | 9.66 | 8.71 | No | — | — | — | Inv. |
| EM-5 | T-3 | 37.4 | 8.6 | 22.3 | 27.4 | 1.23 | 13.0 | 8.84 | 8.71 | No | — | — | — | Comp. |
| EM-6 | T-2 | 66.9 | 21.7 | 10.5 | 33.7 | 3.21 | 13.0 | 8.82 | 8.71 | No | — | — | — | Comp. |
| EM-7 | T-3 | 64.7 | 28.2 | 13.1 | 24.5 | 1.87 | 13.0 | 8.79 | 8.71 | No | — | — | — | Comp. |
| EM-8 | T-3 | 79.6 | 11.9 | 15.2 | 17.0 | 1.12 | 7.0 | 7.45 | 7.93 | No | — | — | — | Comp. |

TABLE 2-continued

| Emul-sion | Seed emul-sion | Tabular grains (%) | V.C. of grain size (%) | x (%) | y (%) | y/x | Iodide content (mol %) Inter-nal layer | Grain sur-face | Over-all | Dislo-cation line | Ir content (mol/mol Agx) Overall | Surface | Ag con-tent | Re-mark |
|---|---|---|---|---|---|---|---|---|---|---|---|---|---|---|
| EM-9 | T-3 | 82.3 | 11.5 | 15.7 | 17.9 | 1.14 | 13.0 | 10.08 | 8.71 | No | $4.85 \times 10^{-8}$ | $8.97 \times 10^{-9}$ | 3.3 | Inv. |
| EM-10 | T-3 | 80.2 | 11.6 | 16.0 | 18.2 | 1.14 | 13.0 | 9.92 | 8.71 | No | $5.01 \times 10^{-8}$ | $1.26 \times 10^{-9}$ | 3.1 | Inv. |
| EM-11 | T-1 | 71.5 | 24.4 | 10.6 | 34.9 | 3.29 | 13.0 | 9.86 | 8.71 | No | $4.83 \times 10^{-8}$ | $6.44 \times 10^{-9}$ | 3.2 | Comp. |
| EM-12 | T-3 | 83.1 | 12.1 | 13.1 | 14.3 | 1.09 | 35.5 | 14.73 | 9.06 | Yes | $4.96 \times 10^{-8}$ | $7.15 \times 10^{-9}$ | 3.4 | Inv. |

In the Table, the percentage of tabular grains indicates those having an aspect ratio of 5 or more, based on the grain projected area; x represent a variation coefficient of a spacing between at least two twin planes; and y represents a variation coefficient of grain thickness. The spacing between twin planes and grain thickness were determined in transmission electron microscopy at a acceleration voltage of 200 kV and a temperature of −120° C. (JEM-2000FX, produced by Nihon Denshi Co.)

The amount of iridium contained in the surface portion was determined in the following manner. The overall iridium content of grains (X) and the iridium content of the grains which have been subjected to surface dissolving treatment afore-mentioned (Y) were each measured. Difference of X-Y was defined as an iridium content in the surface portion. The silver content (%) of the surface portion is also shown in the Table.

Example 2

Preparation of photographic material

Emulsions EM-1 through EM-12 were each subjected to gold-sulfur sensitization and using these emulsions, the following layers having the composition described below were coated on a cellulose triacetate film support in this order from the support to prepare a multi-layered color photographic material.

A color photographic material 101 was as shown below, wherein the addition amount was expressed in g per $m^2$, unless otherwise noted. The coating amount of silver halide or colloidal silver was converted to silver. With respect to a sensitizing dye, it was expressed in mol per mol of silver halide contained in the same layer.

| | |
|---|---|
| 1st layer; Antihalation layer | |
| Black colloidal silver | 0.16 |
| UV absorbent (UV-1) | 0.20 |
| High boiling solvent (OIL-1) | 0.16 |
| Gelatin | 1.60 |
| 2nd layer; Interlayer | |
| Compound (SC-1) | 0.14 |
| High boiling solvent (OIL-2) | 0.17 |
| Gelatin | 0.80 |
| 3rd layer; Low speed red-sensitive layer | |
| Silver iodobromide emulsion A | 0.15 |
| Silver iodobromide emulsion B | 0.35 |
| Sensitizing dye (SD-1) | $2.0 \times 10^{-4}$ |
| Sensitizing dye (SD-2) | $1.4 \times 10^{-4}$ |
| Sensitizing dye (SD-3) | $1.4 \times 10^{-5}$ |
| Sensitizing dye (SD-4) | $0.7 \times 10^{-4}$ |
| Cyan coupler (C-1) | 0.53 |
| Colored cyan coupler (CC-1) | 0.04 |

-continued

| | |
|---|---|
| DIR compound (D-1) | 0.025 |
| High boiling solvent (OIL-3) | 0.48 |
| Gelatin | 1.09 |
| 4th layer; Medium speed red-sensitive layer | |
| Silver iodobromide emulsion B | 0.30 |
| Silver iodobromide emulsion C | 0.34 |
| Sensitizing dye (SD-1) | $1.7 \times 10^{-4}$ |
| Sensitizing dye (SD-2) | $0.86 \times 10^{-4}$ |
| Sensitizing dye (SD-3) | $1.15 \times 10^{-5}$ |
| Sensitizing dye (SD-4) | $0.86 \times 10^{-4}$ |
| Cyan coupler (C-1) | 0.33 |
| Colored cyan coupler (CC-1) | 0.013 |
| DIR compound (D-1) | 0.02 |
| High boiling solvent (OIL-1) | 0.16 |
| Gelatin | 0.79 |
| 5th layer; High speed red-sensitive layer | |
| Silver iodobromide emulsion EM-1 | 0.95 |
| Sensitizing dye (SD-1) | $1.0 \times 10^{-4}$ |
| Sensitizing dye (SD-2) | $1.0 \times 10^{-4}$ |
| Sensitizing dye (SD-3) | $1.2 \times 10^{-5}$ |
| Cyan coupler (C-2) | 0.14 |
| Colored cyan coupler (CC-1) | 0.016 |
| High boiling solvent (OIL-1) | 0.16 |
| Gelatin | 0.79 |
| 6th layer; Interlayer | |
| Compound (SC-1) | 0.09 |
| High boiling solvent (OIL-2) | 0.11 |
| Gelatin | 0.80 |
| 7th layer; Low speed green-sensitive layer | |
| Silver iodobromide emulsion A | 0.12 |
| Silver iodobromide emulsion B | 0.38 |
| Sensitizing dye (SD-4) | $4.6 \times 10^{-5}$ |
| Sensitizing dye (SD-5) | $4.1 \times 10^{-4}$ |
| Magenta coupler (M-1) | 0.14 |
| Magenta coupler (M-2) | 0.14 |
| Colored magenta coupler (CM-1) | 0.06 |
| High boiling solvent (OIL-4) | 0.34 |
| Gelatin | 0.70 |
| 8th layer; Interlayer | |
| Gelatin | 0.41 |
| 9th layer; Medium speed green-sensitive layer | |
| Silver iodobromide emulsion B | 0.30 |
| Silver iodobromide emulsion C | 0.34 |
| Sensitizing dye (SD-6) | $1.2 \times 10^{-4}$ |
| Sensitizing dye (SD-7) | $1.2 \times 10^{-4}$ |
| Sensitizing dye (SD-8) | $1.2 \times 10^{-4}$ |
| Magenta coupler (M-1) | 0.04 |
| Magenta coupler (M-2) | 0.04 |
| Colored magenta coupler (CM-1) | 0.017 |
| DIR compound (D-2) | 0.025 |
| DIR compound (D-3) | 0.002 |
| High boiling solvent (OIL-5) | 0.12 |
| Gelatin | 0.50 |

-continued

| | |
|---|---|
| 10th layer; High speed green-sensitive layer | |
| Silver iodobromide emulsion D | 0.95 |
| Sensitizing dye (SD-6) | $7.1 \times 10^{-5}$ |
| Sensitizing dye (SD-7) | $7.1 \times 10^{-5}$ |
| Sensitizing dye (SD-8) | $7.1 \times 10^{-5}$ |
| Magenta coupler (M-1) | 0.09 |
| Colored magenta coupler (CM-2) | 0.011 |
| High boiling solvent (OIL-4) | 0.11 |
| Gelatin | 0.79 |
| 11th layer; Yellow filter layer | |
| Yellow colloidal silver | 0.08 |
| Compound (SC-1) | 0.15 |
| High boiling solvent (OIL-2) | 0.19 |
| Gelatin | 1.10 |
| 12th layer; Low speed blue-sensitive layer | |
| Silver iodobromide emulsion A | 0.12 |
| Silver iodobromide emulsion B | 0.24 |
| Silver iodobromide emulsion C | 0.12 |
| Sensitizing dye (SD-9) | $6.3 \times 10^{-5}$ |
| Sensitizing dye (SD-10) | $1.0 \times 10^{-5}$ |
| Yellow coupler (Y-1) | 0.50 |
| Yellow coupler (Y-2) | 0.50 |
| DIR compound (D-4) | 0.04 |
| DIR compound (D-5) | 0.02 |
| High boiling solvent (OIL-2) | 0.42 |
| Gelatin | 1.40 |

-continued

| | |
|---|---|
| 13th layer; High speed blue-sensitive layer | |
| Silver iodobromide emulsion C | 0.15 |
| Silver iodobromide emulsion E | 0.80 |
| Sensitizing dye (SD-9) | $8.0 \times 10^{-5}$ |
| Sensitizing dye (SD-11) | $3.1 \times 10^{-5}$ |
| Yellow coupler (Y-1) | 0.12 |
| DIR compound (D-6) | 0.02 |
| High boiling solvent (OIL-2) | 0.05 |
| Gelatin | 0.79 |
| 14th layer; First protective layer | |
| Silver iodobromide emulsion (Av. grain size of 0.08 μm, 1 mol % iodide) | 0.40 |
| UV absorbent (UV-1) | 0.065 |
| High boiling solvent (OIL-1) | 0.07 |
| High boiling solvent (OIL-3) | 0.07 |
| Gelatin | 0.65 |
| 15th layer; Second protective layer | |
| Alkali-soluble matting agent (PM-1, Av. 2 μm) | 0.15 |
| Polymethylmethacrylate (Av. 3 μm) | 0.04 |
| Slipping agent (WAX-1) | 0.04 |
| Gelatin | 0.55 |

In addition to the above composition were added coating aids (SU-1 and 2), viscosity-adjusting agent (V-1), Hardener (H-1 and 2), stabilizer (ST-1), fog restrainer (AF-1), dye (AI-1 and 2), AF-2 comprising two kinds of weight-averaged molecular weights of 10,000 and 1.100,000 and antimold (DI-1).

C-1

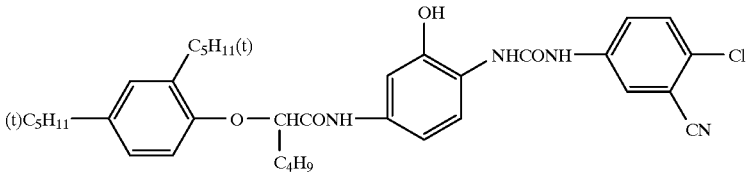

C-2

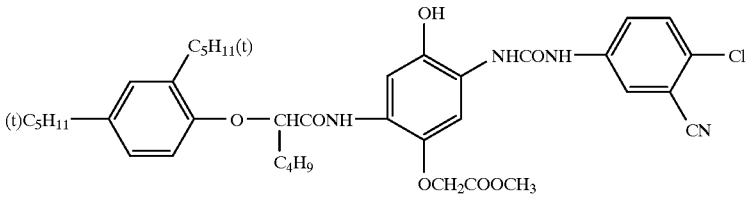

M-1

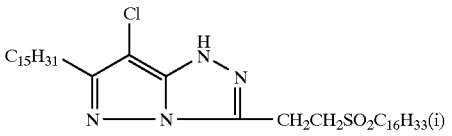

M-2

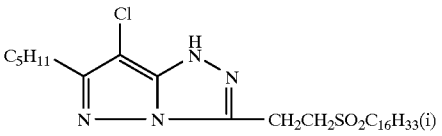

-continued
Y-1
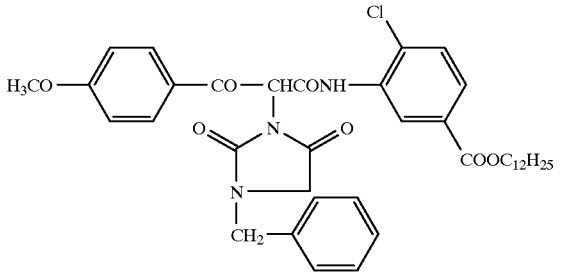
Y-2
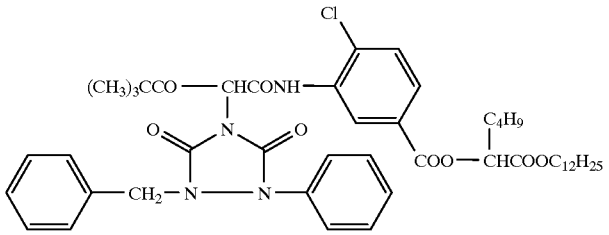
CC-1
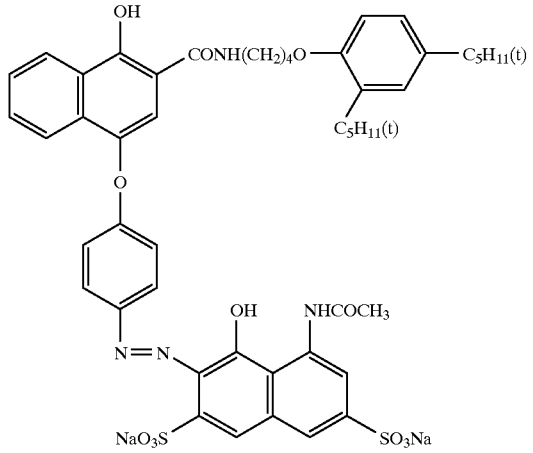
CM-1
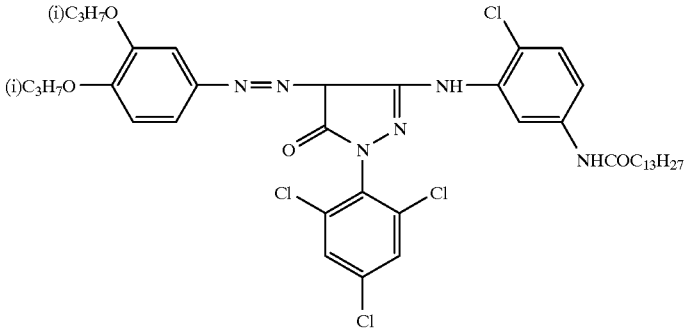

-continued
CM-2
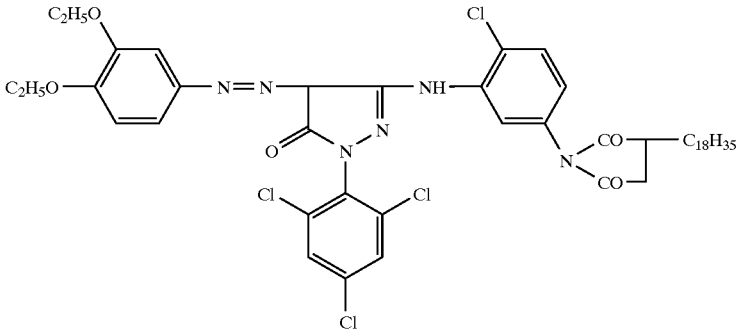
D-1
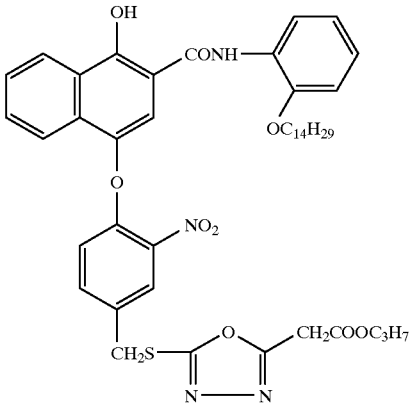
D-2
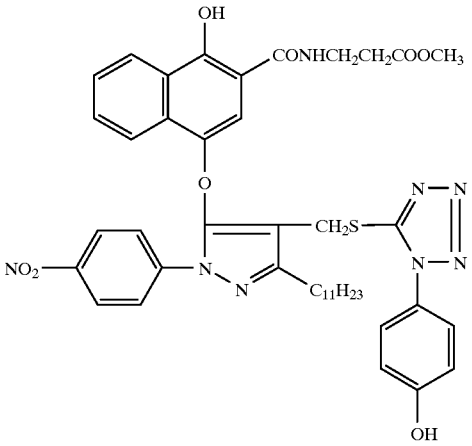

-continued
D-3
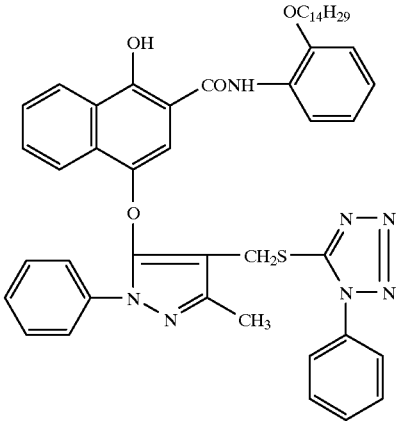
D-4
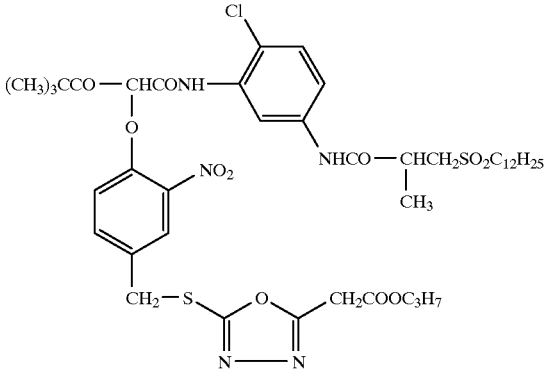
D-5
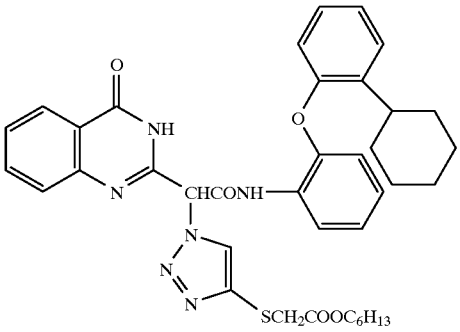
D-6
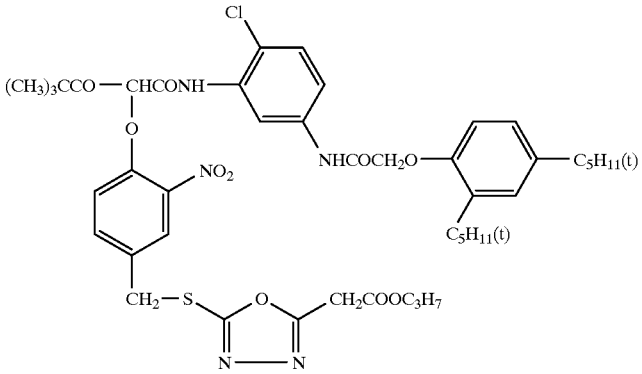

-continued
OIL-1
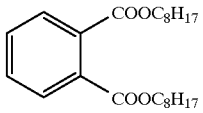
OIL-2
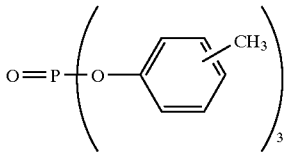
OIL-3
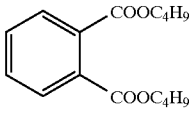
OIL-4
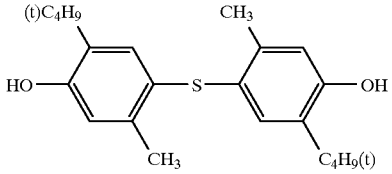
OIL-5
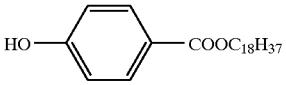
SC-1
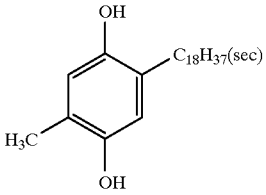
UV-1
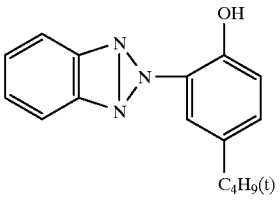
WAX-1
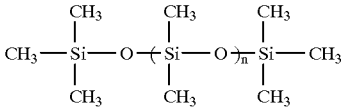
Weight-averaged molecular weight (MW):3,000
Su-1
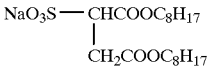

-continued
Su-2
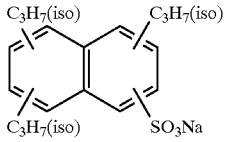
SD-1
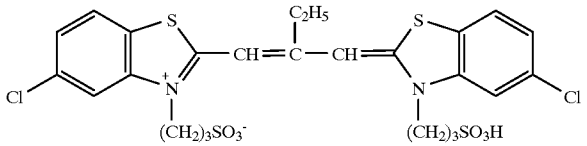
SD-2
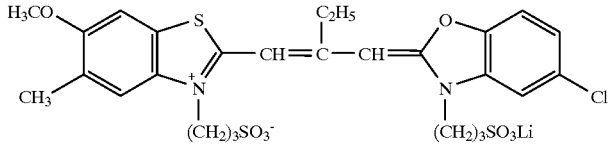
SD-3
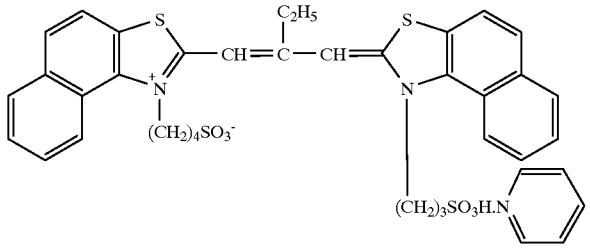
SD-4
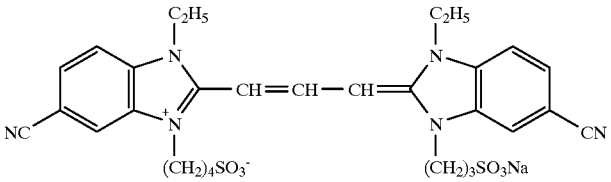
SD-5
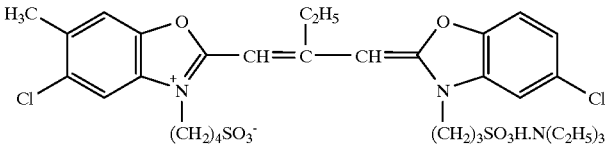
SD-6
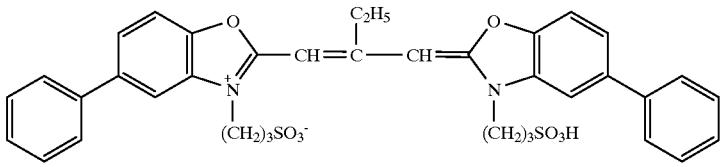
SD-7
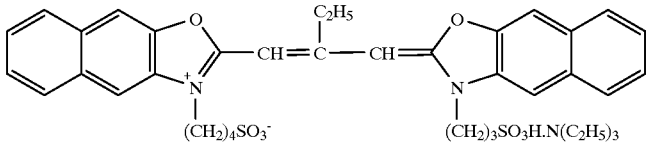

-continued
SD-8
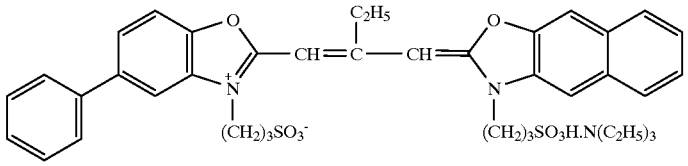
SD-9
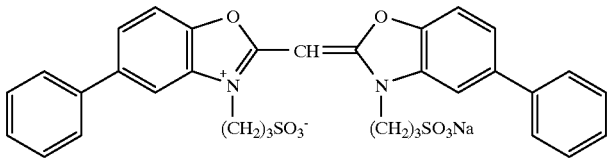
SD-10
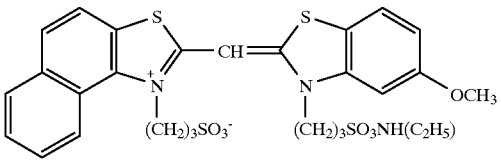
SD-11
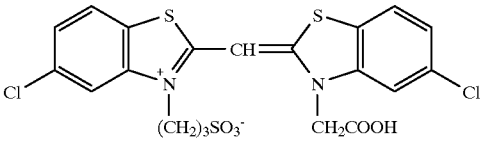
H-1
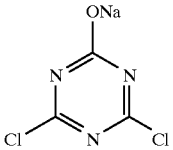
H-2
$(CH_2{=}CHSO_2CH_2)_2O$
ST-1
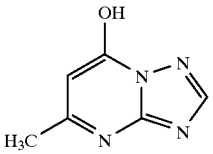
AF-1
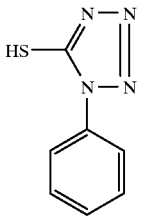

-continued

AF-2

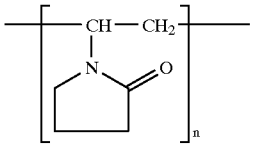

n: Degree of polymerization

DI-1(mixture)

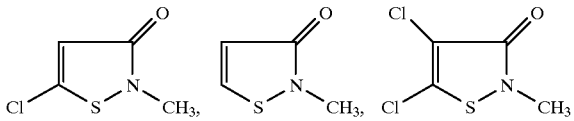

(A) (B) (C)

A:B:C = 3:3:4 (molar ratio)

PM-1

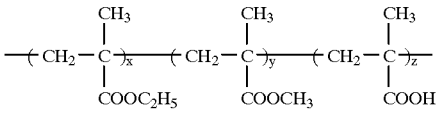

x:y:z = 3:3:4

Emulsions A, B, C, D and E are summarized in Table 3. Each emulsion was subjected to gold-sulfur sensitization. In the Table, diameter/thickness represents the ratio of the grain diameter to the grain thickness of each emulsion.

TABLE 3

| Emulsion | Av. iodide content (mol %) | Av. grain diameter (μm) | Crystal habit | diameter/ thickness |
|---|---|---|---|---|
| A | 4.0 | 0.41 | Regular | 1 |
| B | 6.0 | 0.57 | Regular | 1 |
| C | 6.0 | 0.75 | Regular | 1 |
| D | 6.0 | 1.16 | Tabular | 4 |
| E | 6.0 | 1.30 | Tabular | 4 |

Photographic material samples 102 to 112 were prepared in the same manner as photographic material 101, except that emulsion EM-1 was replaced by EM-2 to EM-12, respectively. Samples were each subjected to wedge-exposure (1/100") and color processing.

Processing steps are as follows:

| | | |
|---|---|---|
| 1. Color developing | 3 min. 15 sec. | 38.0 ± 0.1° C. |
| 2. Bleach | 6 min. 30 sec. | 38.0 ± 3.0° C. |
| 3. Washing | 3 min. 15 sec. | 24–41° C. |
| 4. Fixing | 6 min. 30 sec. | 38.0 ± 3.0° C. |
| 5. Washing | 3 min. 15 sec. | 24–41° C. |
| 6. Stabilizing | 3 min. 15 sec. | 38.0 ± 3.0° C. |
| 7. Drying | | 50° C. or less |

Composition of a processing solution used in each step is as follows.

| | |
|---|---|
| Color developing solution | |
| 4-Amino-3-methyl-N-ethyl-N-(β-hydroxy ethyl)aniline sulfate | 4.75 g |
| Sodium sulfite anhydride | 4.25 g |

-continued

| | |
|---|---|
| Hydroxylamine ½ sulfate | 2.0 g |
| Potassium carbonate anhydride | 37.5 g |
| Sodium bromide | 1.3 g |
| Trisodium nitrilotriacetate (monohydrate) | 2.5 g |
| Potassium hydroxide | 1.0 g |
| Water to make | 1 liter |
| The pH was adjusted to 10.1. | |
| Bleaching solution | |
| Ammonium ferric ethylenediaminetetraacetate | 100.0 g |
| Diammonium ethylenediaminetetraacetate | 10.0 g |
| Ammonium bromide | 150.0 g |
| Glacial acetic acid | 10.0 g |
| Water to make | 1 liter |
| The pH was adjusted to 6.0 using ammonia water. | |
| Fixing solution | |
| Ammonium thiosulfate | 175.0 g |
| Sodium sulfite anhydride | 8.5 g |
| Sodium metasulfite | 2.3 g |
| Water to make | 1 liter |
| The pH was adjusted to 6.0 with acetic acid. | |
| Stabilizing solution | |
| Formalin (37% aqueous solution) | 1.5 ml |
| Koniducks (product by Konica Corp.) | 7.5 ml |
| Water to make | 1 liter |

Processed photographic materials were evaluated with respect to photographic characteristics of the red-sensitive layer.

Sensitivity

Sensitivity was shown as a relative value of reciprocal of exposure giving a magenta density of Dmin (minimum density)+0.15, based on that of Sample 101 being 100. The highere the value, the higher the sensitivity.

Graininess

Graininess was shown as a relative value of a standard deviation of density variation (RMS value) at a density of Dmin+0.50 which was measured with a microdensitometer, based on that of Sample 101 being 100. The lower the RMS value, the better the graininess.

Pressure characteristics

After contacting with a needle having a 0.025 mm curvature radius of the point, loaded with a load of 5 g and moving at a constant speed using a scratch tester (produced by Shinto Kagaku) at 23° C and 55% RH, photographic material samples were each exposed and processed. The density variation, at a density of Dmin+0.40, of the loaded portion (ΔD) was measured. ΔD, which indicates a measure of pressure resistance, is represented as a relative value, based on that of Sample 101 being 100. The lower the value of ΔD, the better the pressure resistance.

High intensity reciprocity failure characteristics (HIRF)

After being subjected to exposure at 1/10000 sec., photographic material samples were processed within 1 min of the exposure. The sensitivity of high intensity exposure was shown as a relative value, based on the above-described relative sensitivity of Sample 101 being 100. The lower the difference between the relative sensitivity and the high intensity exposure sensitivity , the more improved the high intensity reciprocity failure.

Results thereof are shown in Table 4.

TABLE 4

| Sample | Emulsion | Sensitivity | Graininess | Pressure (ΔD) | HIRF | Remark |
|---|---|---|---|---|---|---|
| 101 | EM-1 | 100 | 100 | 100 | 98 | Inv. |
| 102 | EM-2 | 81 | 123 | 119 | 63 | Comp. |
| 103 | EM-3 | 109 | 98 | 101 | 104 | Inv. |
| 104 | EM-4 | 95 | 102 | 105 | 90 | Inv. |
| 105 | EM-5 | 52 | 96 | 106 | 54 | Comp. |
| 106 | EM-6 | 68 | 134 | 115 | 51 | Comp. |
| 107 | EM-7 | 71 | 137 | 120 | 62 | Comp. |
| 108 | EM-8 | 74 | 125 | 131 | 67 | Comp. |
| 109 | EM-9 | 103 | 103 | 104 | 103 | Inv. |
| 110 | EM-10 | 102 | 100 | 101 | 98 | Inv. |
| 111 | EM-11 | 82 | 121 | 123 | 67 | Comp. |
| 112 | EM-12 | 118 | 96 | 97 | 118 | Inv. |

As can be seen from Table 4, it is proved that inventive samples exhibited higher sensitivity, superior graininess, and improved pressure resistance and high intensity reciprocity failure characteristics. Specifically, Sample 112, which was one of the best mode of the invention, exhibited excellent photographic performance.

What is claimed is:

1. A silver halide light sensitive photographic material comprising a support having thereon a silver halide emulsion layer containing silver halide grains, wherein at least 50% of the total projected area of silver halide grains contained in the emulsion layer is accounted for by tabular grains having an aspect ratio of not less than 5 and an even number of parallel twin planes, the tabular grains satisfying the following requirements:

(A) a coefficient of variation of grain size being 20% or less, (B) $0.7 \leqq y/x \leqq 2.0$, where x represent a coefficient of variation of twin plane spacing and y represents a coefficient of variation of grain thickness, and (C) the grains having, in the interior of the grain, an internal layer having an iodide content higher than that of the grain surface, and the iodide content of the grain surface being higher than an average overall iodide content of the grains.

2. The silver halide photographic material of claim 1, wherein the coefficient of variation of twin plane spacing is not more than 30%.

3. The silver halide photographic material of claim 1, wherein the coefficient of variation of grain thickness is not more than 30%.

4. The silver halide photographic material of claim 1, wherein the iodide content of the grain surface is between 2.6 and 16 mol %.

5. The silver halide photographic material of claim 1, wherein the difference in the iodide content between the internal layer and the grainn surface is 2 mol % or more.

6. The silver halide photographic material of claim 1, wherein said tabular grains each have dislocation lines of 5 or more.

7. The silver halide photographic material of claim 1, wherein said tabular grains contain a polyvalent metal compound, and the grain surface containing the polyvalent metal compound in an amount of 1/20 or more of an average overall content of the polyvalent metal compound.

* * * * *